US009716940B2

(12) United States Patent
Roberts

(10) Patent No.: US 9,716,940 B2
(45) Date of Patent: Jul. 25, 2017

(54) ACOUSTIC DEVICE

(71) Applicant: Campobello Limited, London (GB)

(72) Inventor: Davies Richard Roberts, Shoreham-by-Sea (GB)

(73) Assignee: FLARE AUDIO TECHNOLOGIES LIMITED, Lancing, West Sussex (GB)

( * ) Notice: Subject to any disclaimer, the term of this patent is extended or adjusted under 35 U.S.C. 154(b) by 0 days.

(21) Appl. No.: 14/778,005

(22) PCT Filed: Mar. 14, 2014

(86) PCT No.: PCT/GB2014/050800

§ 371 (c)(1),
(2) Date: Sep. 17, 2015

(87) PCT Pub. No.: WO2014/147378

PCT Pub. Date: Sep. 25, 2014

(65) Prior Publication Data

US 2016/0286303 A1 Sep. 29, 2016

(30) Foreign Application Priority Data

Mar. 22, 2013 (GB) ..... 1305279.0
May 13, 2013 (GB) ..... 1308543.6
Jul. 30, 2013 (GB) ..... 1313610.6

(51) Int. Cl.
*H04R 1/20* (2006.01)
*H04R 1/28* (2006.01)
*H04R 1/02* (2006.01)

(52) U.S. Cl.
CPC ..... *H04R 1/2803* (2013.01); *H04R 1/02* (2013.01); *H04R 1/021* (2013.01); *H04R 1/2811* (2013.01);
(Continued)

(58) Field of Classification Search
CPC .. H04R 1/2819; H04R 1/2826; H04R 1/2834; H04R 1/2842; H04R 1/2857;
(Continued)

(56) References Cited

U.S. PATENT DOCUMENTS 3,687,220 A 8/1972 Virva
4,168,761 A * 9/1979 Pappanikolaou .... H04R 1/2857 181/152

(Continued)

FOREIGN PATENT DOCUMENTS

EP 0336303 A2 10/1989
EP 0361445 A2 4/1990

(Continued)

OTHER PUBLICATIONS

United Kingdom Intellectual Property Office Search Report under Section 17 dated Jan. 27, 2014, United Kingdom Application No. GB1313610.6.

(Continued)

*Primary Examiner* — Huyen D Le
(74) *Attorney, Agent, or Firm* — Robert G. Crouch; Marsh Fischmann & Breyfogle LLP

(57) ABSTRACT

An acoustic device (90) for use with a movable loudspeaker element (12), the acoustic device defining an enclosure (16) with an aperture to locate the movable loudspeaker element (12), and with a port (20, 28) communicating with the outside of the enclosure, wherein the acoustic device includes at least one sound-suppressing duct (22) incorporating at least one vortex chamber (24) to absorb sound waves propagating through the duct and so suppress sound waves from the port. The acoustic device (90) may be a driver or a frame for a driver; alternatively it may be a loudspeaker or a housing for a loudspeaker.

15 Claims, 6 Drawing Sheets

(52) U.S. Cl.
CPC ..... *H04R 1/2819* (2013.01); *H04R 1/2826* (2013.01); *H04R 2201/029* (2013.01); *H04R 2400/13* (2013.01)

(58) Field of Classification Search
CPC .... H04R 1/2861; H04R 1/30; H04R 2400/13; H04R 1/021; H04R 1/2803; H04R 1/2811; H04R 2201/029
USPC ..... 381/337, 338, 339, 340, 341, 342, 345, 381/349, 351, 386; 181/148, 152, 153, 181/155, 156, 194, 199
See application file for complete search history.

(56) References Cited

U.S. PATENT DOCUMENTS

| | | | | |
|---|---|---|---|---|
| 4,933,982 | A | 6/1990 | Tanaka | |
| 5,012,890 | A | 5/1991 | Nagi et al. | |
| 5,333,204 | A | 7/1994 | Hamada et al. | |
| 5,373,564 | A | 12/1994 | Spear et al. | |
| 5,821,471 | A | 10/1998 | McCuller | |
| 6,002,781 | A | 12/1999 | Takayama et al. | |
| 6,973,994 | B2 * | 12/2005 | Mackin | H04R 1/00 181/145 |
| 7,450,733 | B2 * | 11/2008 | Suprapmo | H04R 1/2826 381/337 |
| 2005/0022918 | A1 | 2/2005 | McCain | |
| 2005/0133298 | A1 | 6/2005 | Hasegawa | |
| 2008/0169150 | A1 | 7/2008 | Kuo | |
| 2011/0243359 | A1 | 10/2011 | Lin et al. | |

FOREIGN PATENT DOCUMENTS

| | | | |
|---|---|---|---|
| EP | 0589515 | A1 | 3/1994 |
| EP | 0613317 | A1 | 8/1994 |
| EP | 1528836 | A2 | 5/2005 |
| FR | 2452224 | A1 | 10/1980 |
| FR | 2941122 | A1 | 7/2010 |
| FR | 2955731 | A1 | 7/2011 |
| GB | 489588 | A | 7/1938 |
| GB | 2440085 | A | 1/2008 |
| JP | S6120490 | A | 1/1986 |
| JP | H11252672 | A | 9/1999 |
| JP | 2000078681 | A | 3/2000 |
| WO | 01/65533 | A2 | 9/2001 |
| WO | 2008033579 | A2 | 3/2008 |
| WO | 2012135021 | A1 | 10/2012 |

OTHER PUBLICATIONS

United Kingdom Intellectual Property Office Search Report under Section 17 dated Apr. 29, 2013, United Kingdom Application No. GB1305279.0.
International Search Report and Written Opinion of the International Searching Authority dated Jun. 6, 2014, PCT Application No. PCT/GB2014/050800.

* cited by examiner

ACOUSTIC DEVICE

This invention relates to an acoustic device such as loudspeaker, a driver for a loudspeaker, or a housing for a loudspeaker; it also relates to a sound-suppressing duct for such a device.

A loudspeaker usually incorporates a loudspeaker driver, which oscillates in order to produce sound, and a loudspeaker enclosure or housing, to which the loudspeaker driver is mounted. The shape, material and construction of the loudspeaker enclosure, along with the way in which the loudspeaker driver is mounted to the loudspeaker enclosure, have a strong influence on the quality of sound output by the loudspeaker.

A particular problem is that as the driver oscillates forwards and backwards, it creates sound waves in the air behind the driver as well as in the air outside the loudspeaker. The sound waves behind the driver may be contained within the enclosure, if the enclosure is substantially rigid and has no apertures or ports through which the sound waves can emerge. However, with such an enclosed space behind the driver, the pressure fluctuations in the air behind the driver can impede the movement of the driver, and so distort the sound; this problem can be minimised by having a sufficiently large enclosed space. As an alternative, if the space behind the driver is provided with an aperture or port through which the sound waves can emerge, this avoids the problems that arise from pressure fluctuations, but on the other hand there may be interference between sound waves produced by the front of the driver and those produced by the back of the driver and which emerge through the port. This issue is particularly of concern with loudspeakers for producing low frequencies, because of the size of the driver; and such a port may be referred to as a "bass-reflex port". A number of different designs of loudspeaker port have therefore been developed, for example as described in U.S. Pat. No. 4,650,031 (Yamamoto/Bose Corp) and U.S. Pat. No. 6,275,597 (Roozen et al/Philips Corp.).

According to a first aspect there is provided an acoustic device for use with a movable loudspeaker element, the acoustic device defining an enclosure with an aperture to locate the movable loudspeaker element, and with a port communicating with the outside of the enclosure, wherein the acoustic device includes at least one sound-suppressing duct incorporating at least one vortex chamber to absorb sound waves propagating through the duct and so suppress sound waves from the port.

Such an acoustic device may incorporate at least two vortex chambers in series in each such sound-suppressing duct. In that situation the vortex chambers that are in series may be arranged such that successive vortices are in opposite directions.

In a second aspect, the invention provides a sound-suppressing duct for use in such an acoustic device. Such a sound-suppressing duct may therefore comprise at least two vortex chambers in series, and in this case the vortex chambers may be arranged such that successive vortices are in opposite directions.

Such an acoustic device may be of laminated construction. For example it may comprise a plurality of layers held together under compressive force. The plurality of layers may be held under compression between end plates which are of greater stiffness and rigidity than the individual layers. Similarly such a sound-suppressing duct may be of laminated construction, as one option.

The acoustic device may be a housing for a movable loudspeaker element. Alternatively it may be a frame for an acoustic driver. Thus the invention also provides a driver comprising an acoustic device that is such a frame, in combination with a movable loudspeaker element. Equally, the invention would also provide a loudspeaker comprising an acoustic device that is such a housing, in combination with a movable loudspeaker element. The loudspeaker may also include the driver of the invention.

In an alternative aspect, there is provided a housing suitable for use as a housing for a movable loudspeaker element, wherein the housing defines an enclosure with an aperture for the movable loudspeaker element, and with a port communicating with the outside of the housing, wherein the housing includes at least one sound-suppressing duct incorporating at least one vortex chamber to absorb sound waves propagating through the duct and so suppress sound waves from the port.

According to another aspect of the present invention there is provided a loudspeaker comprising a housing defining an enclosure with an aperture for a movable loudspeaker element, and a movable loudspeaker element mounted so as to emit sound through the aperture, the housing also defining a port communicating between a space behind the movable loudspeaker element and the outside of the housing, wherein the housing includes at least one sound-suppressing duct incorporating at least one vortex chamber to absorb sound waves propagating through the duct and so suppress sound waves from the port.

In operation the movable loudspeaker element is arranged to move, and therefore to displace air, and to create sound waves. The movable loudspeaker element would typically be associated with an electrical actuator, and be mounted within a frame, so that the movable loudspeaker element, the electrical actuator and the frame together constitute a loudspeaker driver.

As one option the rear face of the movable loudspeaker element may be enclosed within an enclosing chamber, with at least one outlet communicating with the outside of the enclosing chamber, each outlet incorporating such a sound-suppressing duct incorporating at least one vortex chamber. Such an enclosing chamber may be defined by a frame within which the movable loudspeaker element is mounted.

Alternatively or additionally at least one sound-suppressing duct communicates with the outside of the housing. In this case the sound-suppressing duct may constitute at least part of the port.

In either case each sound-suppressing duct may define a plurality of vortex chambers, arranged in series. Where vortex chambers are arranged in series, the vortex chambers may be arranged so that the vortex direction reverses between one vortex chamber and the next.

In one embodiment a housing is provided with a single such sound-suppressing duct communicating with the outside of the housing; while in another embodiment a housing is provided with multiple such sound-suppressing ducts communicating with the outside of the housing.

It will be appreciated that the sound-suppressing duct of the present invention is applicable to loudspeakers of any size. The use of at least one such sound-suppressing duct may enable the use of a housing of smaller overall volume, as the space behind the loudspeaker driver does not have to comply with conventional volume requirements, because it is vented through the port.

In an embodiment in which the rear face of the movable loudspeaker element is enclosed within an enclosing chamber, with at least one outlet communicating with the outside of the enclosing chamber, each outlet incorporating such a sound-suppressing duct incorporating at least one vortex chamber, the sound-suppressing duct may be defined within a structure that defines the enclosing chamber; or alternatively the sound-suppressing duct may project from the structure that defines the enclosing chamber, or may be separate from the structure that defines the enclosing chamber, as long as the sound-suppressing duct communicates between the inside and the outside of the enclosing chamber.

The enclosing chamber may be defined by the frame. The frame may be of laminated construction, comprising a plurality of layers held together under compressive force. For example a cylindrical chamber may be formed of a plurality of sheets or laminae held together, each defining a circular aperture, so all the apertures align to form the chamber; the sheets may be of a different shape, for example square or rectangular.

Similarly, the housing may be of laminated construction, comprising a plurality of layers held together under compressive force. For example a rectangular housing may be formed of a plurality of rectangular sheets or laminae held together, at least some of the sheets or laminae defining an aperture to form a recess to accommodate the loudspeaker driver.

If the frame or the housing is of laminated construction, there might be between two and a hundred or more, more typically between five and thirty such sheets or laminae held together to define walls of the frame or the housing. The number of sheets or laminae is determined by the thickness of each sheet, and by the desired thickness of the enclosing chamber or of the housing. The laminae may also define cutouts which define the or each sound-suppressing duct when the laminae are assembled together.

Applying a compressive force to a laminated frame or housing can increase the stiffness of the frame or housing, thereby reducing the amplitude of any vibrations of the frame or housing. Moreover, a stiffer frame or housing can have higher resonant frequencies, reducing or even eliminating resonance at frequencies at which the movable loudspeaker element this operates. So if the frame or the housing is of laminated structure, it is preferably held under compression, for example using bolts, between stiff and rigid end plates. The compressive force increases the rigidity or stiffness of the side walls. An additional benefit of the compressive force is to prevent separate elements moving or resonating individually. The overall result is that the entire frame or housing resonates as a single entity. The compressive force may be applied in a direction parallel to the direction of movement of the movable loudspeaker element.

The compressive force must be applied such that side walls are all under substantially uniform compression and so are uniformly rigid; and if there are also internal walls or baffles, they must also be subjected to substantially uniform compression. So for example compressing members (such as bolts) should be sufficiently close together throughout the side walls and any internal walls or baffles that portions that are between adjacent compressing members remain under sufficient compression. The sheets or laminae may be of a material that is not particularly rigid, such as wood, plywood, chipboard, medium-density fibreboard (MDF), or plastic. The compressing members preferably act on force-spreading plates which are of a more rigid material than that of the walls, as they are must be sufficiently rigid and sufficiently large to achieve substantially uniform compression of the portions of the walls that are between adjacent compressing members. For example the force-spreading plates might be discrete plates to spread the force from one or more discrete compressing members, for example the force-spreading plates may be washers. Alternatively they might be end plates covering the entire end of the frame or housing (although an end plate may define an aperture). In one example the force-spreading plates might be steel washers 30 mm in diameter and of thickness 1 or 2 mm, one for each compressing bolt; while in another example the force-spreading plates may be end plates, for example of a metal such as steel, brass, zinc or aluminium, and of thickness at least 2.5 mm thick, and in some cases 5 or 10 mm thick. The dimensions depend upon the size of the frame or the loudspeaker housing. Where washers or similar discrete force-spreading plates are used, the force-spreading plates should be sufficiently large that any resulting gap between adjacent force-spreading plates is no more than 20% of the distance between adjacent compressing members, preferably no more than 10%.

It will be appreciated that loudspeakers are primarily intended for generating audible sound, that is to say sound within the range of frequencies that is audible to a person with normal hearing, which may be taken as about 20 Hz up to about 18 kHz. Nevertheless under some circumstances loudspeakers may be required to generate infra-sound, for example to generate 15 Hz or 10 Hz; and may be required to produce ultrasound frequencies, for example 20 kHz or more. The loudspeakers of the invention can be expected to provide satisfactory performance both in the audible range, and at frequencies above and below the audible range.

Embodiments of the invention are described below, with reference to the accompanying drawings, by way of example only.

BRIEF DESCRIPTION OF THE DRAWINGS

Referring now to FIG. 1, this illustrates schematically a way of making a loudspeaker. According to this first embodiment, there is provided a loudspeaker 10 comprising multiple layers 32. Each layer 32 is substantially flat, and can be described as a sheet or lamina. It may be of any convenient solid material, for example metal, wood, or a wood-based material such as medium-density fibreboard (MDF), plywood, or plastic or paper. In one example each layer 32 is of MDF. In another example each layer 32 is of a plastic, for example an engineering plastic such as acrylonitrile butadiene styrene (ABS), a polyamide (PA), or polyether ether ketone (PEEK).

As shown in FIG. 4, an opening 34 is provided in each layer 32, to define a cavity in which a loudspeaker driver 35 can be mounted. Holes 36 are also provided in each layer 32 for receiving bolts 38. (The bolts 38 are shown schematically in FIG. 1, not to scale, and only three bolts are shown.)

Figure 1:
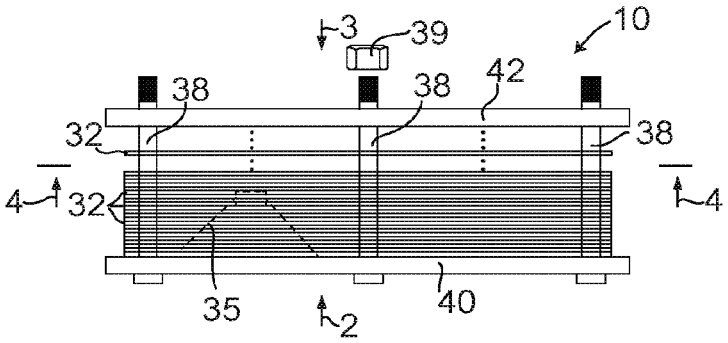
FIG. 1 is a schematic illustration of a loudspeaker according to a first embodiment, showing a side view of the loudspeaker housing during assembly.

The loudspeaker 10 has a front plate 40 and a rear plate 42. The front plate 40 and rear plate 42 are stiffer than the layers 32, and in this embodiment thicker, and are of a more rigid material. For example they may be 20 mm thick sheets of aluminium. Like the layers 32, the front and rear plates 40 and 42 have holes 43 for the bolts 38. Hence the loudspeaker 10 is assembled by forming a stack of the layers 32 between the front plate 40 and the rear plate 42, inserting the bolts 38, attaching a nut 39 to each bolt 38, and tightening all the bolts 38 so that the laminated walls of the loudspeaker 10 are compressed.

During assembly, as the bolts 38 are tightened, if you tap on the sidewall the tone of the resulting noise provides a clear indication as to when an adequate compressive force has been achieved as the tone will change from a dull knock to a much higher pitched note. The amount of compressive force required depends on the material of the layers 32, the depth of the housing (between the end plates 40 and 42) and the thickness of the side walls of the resulting cavity defined by the openings 34. The compressive force is significantly greater than that which would be achieved only by conventional tightening of the bolts 38.

Figure 2:
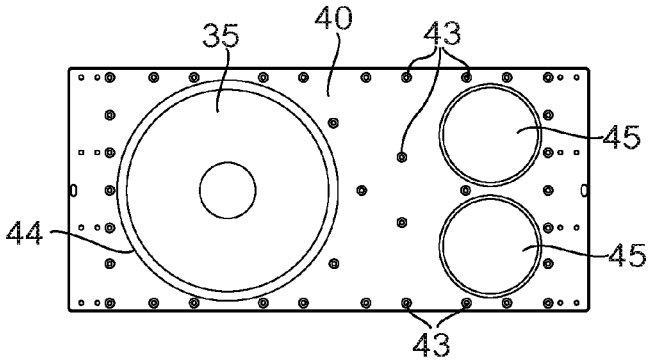
FIG. 2 is a plan view of the front plate of the loudspeaker of FIG. 1, in the direction of arrow 2 of FIG. 1.

As shown in FIG. 2, the front plate 40 defines an aperture 44 behind which the loudspeaker driver 35 is mounted. The front plate 40 also defines two circular ports 45.

Figure 3:
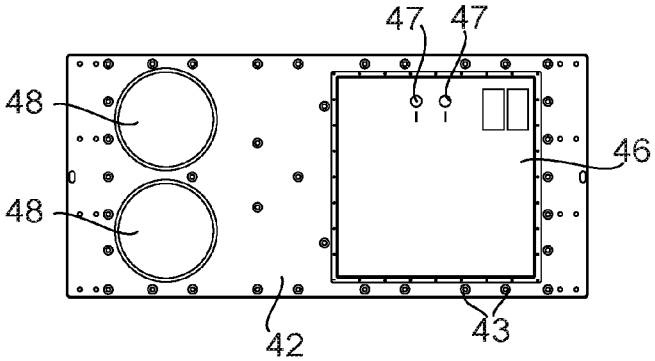
FIG. 3 is a plan view of the rear plate of the loudspeaker of FIG. 1, in the direction of arrow 3 of FIG. 1.

Referring now to FIG. 3, the rear plate 42 has a square access port behind the loudspeaker driver 35, sealed with a cover plate 46 provided with electrical connections 47 to the loudspeaker driver 35. The rear plate 42 also defines two circular ports 48 that are aligned with the circular ports 45 through the front plate 40.

Figure 4:
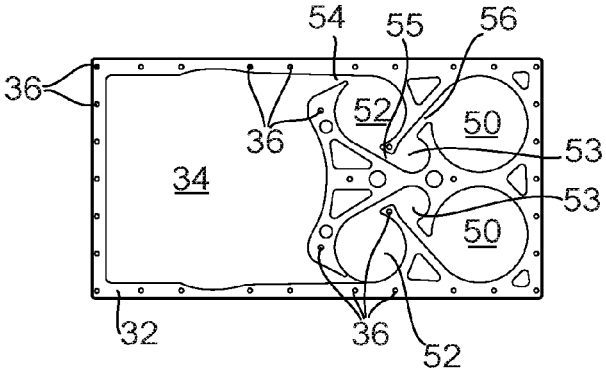
FIG. 4 is a plan view of one of the sheets of the loudspeaker of FIG. 1, equivalent to a view on the line 4-4 of FIG. 1.

Referring now to FIG. 4, each layer 32 defines not only the opening 34 (towards the left-hand side as shown), but also two circular openings 50 (towards the right-hand side as shown) which align with the circular ports 45 and 48. Within each layer 32 the opening 34 communicates with the openings 50 through two successive circular apertures 52 and 53. The opening 34 communicates through a narrow slot 54 with the circular aperture 52, the slot 54 being aligned tangentially with the circular aperture 52; the circular aperture 52 communicates through a narrow slot 55 with the circular aperture 53, the slot 55 being aligned tangentially with both the circular aperture 52 and the circular aperture 53; and the circular aperture 53 communicates through a narrow slot 56 with the circular opening 50, the narrow slot 56 being aligned tangentially with both the circular aperture 53 and the circular opening 50.

In the assembled loudspeaker 10 the circular openings 50 thus provide outlet ports which communicate with the cavity defined by the openings 34, behind the loudspeaker driver 35. However, if air flows between the cavity defined by the openings 34 and either one of the circular openings 50 it will set up vortices within the cylindrical chamber defined by the circular apertures 52, within the cylindrical chamber defined by the circular apertures 53, and within the cylindrical chamber defined by the circular openings 50; and the successive vortices are in opposite directions. This has the effect of suppressing the transmission of audible sound waves.

Consequently, in use, the sound waves are emitted from the front face of the loudspeaker driver 35, but no sound waves are emitted by the loudspeaker 10 originating from the rear face of the loudspeaker driver 35. This provides clearer and more accurate sound reproduction. Thus the slits 54, apertures 52, slot 55, apertures 53, slots 56 and openings 50 together define two sound-suppressing ducts which include vortex chambers.

It will be appreciated that the loudspeaker 10 may be modified in various ways. In particular, the ports 45 and 48 may be of a different size to the circular openings 50. For example the ports 45 and 48 may be of a smaller diameter than the circular openings 50. This increases the effectiveness of the vortex within the cylindrical port defined by the circular openings 50, because it creates a circumferential lip at each end of the port. In a further modification there are ports 45 in the front plate 40, but no ports 48 in the rear plate 42; or alternatively there are ports 48 in the rear plate 42 but no ports 45 in the front plate 40.

In another alternative arrangement the layers in one part of the stack define circular apertures 52 that communicate through a narrow slot 54 with the opening 34, and also define circular openings 50, but the circular apertures 52 do not communicate with the circular openings 50; in another part of the stack the layers define circular apertures 52 that communicate through a tangentially aligned slot with the circular openings 50, but the circular apertures 52 do not communicate with the opening 34. These two parts of the stack are separated by a layer which defines the opening 34 and the circular openings 50, and defines a small circular aperture aligned with the centre of the circular apertures 52. Hence any airflow between the cavity defined by the openings 34 and the port defined by the openings 50 will follow a vortex path within the circular apertures 52 in the first part of the stack, outflowing through the small circular aperture at the centre, then following a path through the circular apertures 52 in the second part of the stack, and emerging to form a vortex in the ports defined by the circular openings 50.

The loudspeaker 10 as described above is of rectangular shape, the left-hand portion providing the cavity to accommodate the loudspeaker driver 35 and the right-hand portion defining the vortex chambers and the outlet ports. It will be appreciated that a similar loudspeaker may have a square shape.

Figure 5:
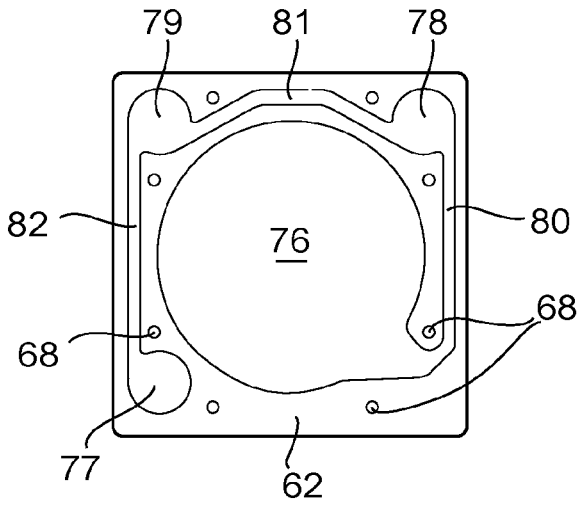
FIG. 5 is a plan view of a sheet to form a loudspeaker which is a modification of the loudspeaker of FIG. 1.
Figure 6:
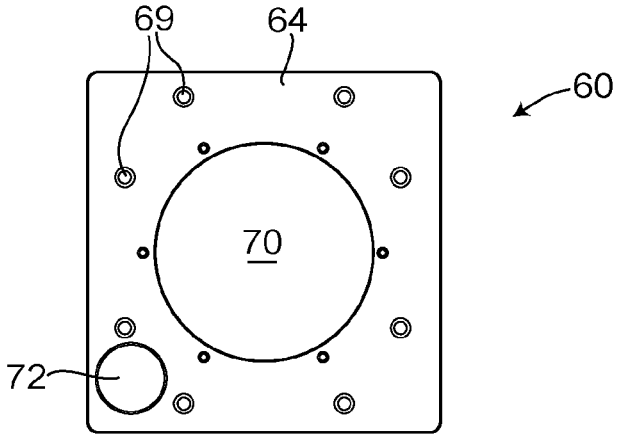
FIG. 6 is a plan view of the front plate of the loudspeaker of FIG. 5.
Figure 7:
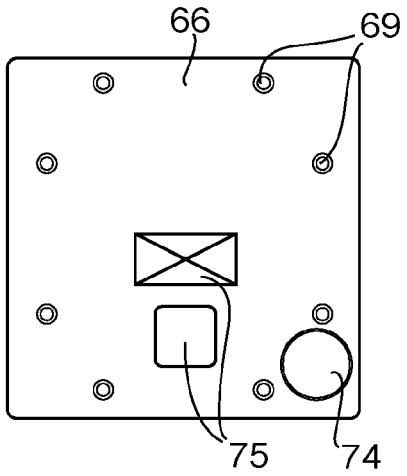
FIG. 7 is a plan view of the rear plate of the loudspeaker of FIG. 5.

Referring now to FIGS. 5-7, a loudspeaker 60 is formed in substantially the same way as shown in FIG. 1, consisting of a stack of layers 62 (shown in FIG. 5) which are assembled between a front plate 64 (shown in FIG. 6) and a rear plate 66 (shown in FIG. 7). There are holes 68 in the layers 62 for bolts 38 (as in FIG. 1); there are corresponding holes 69 in both the front plate 64 and the rear plate 66. Only eight holes 68 and 69 are shown, but in practice there may be more such holes 68 and 69, and so more bolts 38.

The front plate 64 defines a central circular aperture 70 behind which a loudspeaker driver 35 (as shown in FIG. 1) is mounted, and defines a port 72 at the bottom left-hand corner as shown. The rear plate 66 defines a port 74 which is aligned with the port 72; and also defines sockets 75 for electrical connection to the loudspeaker driver 35.

Each layer 62 defines a central circular aperture 76 to define a chamber to accommodate the loudspeaker driver 35; and each layer 62 defines a circular opening 77 which is aligned with the ports 72 and 74. Within each layer 62 the central circular aperture 76 communicates with the circular opening 77 through two successive circular apertures 78 and 79 which are adjacent to the top two corners of the layer 62 (as shown). The central circular aperture 76 communicates through a narrow slot 80 with the circular aperture 78, the slot 80 being aligned tangentially with the circular aperture 78; the circular aperture 78 communicates through a narrow slot 81 with the circular aperture 79, the slot 81 being aligned tangentially with both the circular apertures 78 and 79; and the circular aperture 79 communicates through a narrow slot 82 with the circular opening 77, the narrow slot 82 being aligned tangentially with both the circular aperture 79 and the circular opening 77.

The loudspeaker 60, when assembled, consequently operates in substantially the same way as the loudspeaker 10 described above. The circular openings 77 provide outlet ports which communicate with the cavity defined by the openings 76, behind the loudspeaker driver 35. However, if air flows between that cavity and that outlet port, it will set up vortices within the cylindrical chamber defined by the circular apertures 78, within the cylindrical chamber defined by the circular apertures 79, and within the cylindrical chamber defined by the circular openings 77; and the successive vortices are in opposite directions. This has the effect of suppressing the transmission of audible sound waves. Thus the slots 80, 81 and 82, the apertures 78 and 79 and the opening 77 together constitute a sound-suppressing duct.

Consequently, in use, the sound waves are emitted from the front face of the loudspeaker driver 35, but no sound waves are emitted by the loudspeaker 60 originating from the rear face of the loudspeaker driver 35. This provides clearer and more accurate sound reproduction. The loudspeaker 60 provides a more compact design, which is more suitable when making loudspeakers of minimal volume. In one example the dimensions are 420 mm×420 mm, and 180 mm thick; and in another example the dimensions are 250 mm×250 mm, and 280 mm thick.

It is expected that loudspeakers made in accordance with the present invention would have a wide range of different applications, for example they may be used for loudspeakers of any type, size, or frequency range, from the very small to the very large, for application in a wide range of different fields including professional audio, home audio, portable audio, headphones, laptops, mobile phones. Other loudspeaker fields where benefits would be provided may include the following: Automotive—rigid shapes could be made to fit within specific or restricted spaces, to improve car audio quality, without any cost penalty. These devices could also be thinner and at the same time improve sound quality, and reduce weight and cost. Aircraft—this would improve aircraft sound systems both in quality and reduced weight. Industrial and public space—large high-power loudspeakers may be improved in sound quality and longevity, with reduced manufacturing cost. Laptops, television and portable entertainment devices—low cost manufacture with increased sound quality and reduced weight. Boats—problems from water and salt may be reduced by appropriate selection of materials. Fire and burglar alarms and evacuation speakers—fire proof and heat resistant material could be used to produce a fire resistant and tamper proof loudspeaker.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

One such modification relates to the inside surfaces of the front plate 40, 64 or of the rear plate 42, 66, that is to say those surfaces that face the layers 32, 62. Those portions of the inside surfaces that are in contact with a layer 32, 62 must be rigid in order to ensure that the layers 32, 62 are under compression. Those portions of the inside surfaces that align with an aperture 52, 53; 78, 79, or a slot 54, 55, 56; 80, 81, 82 do not have to be so rigid, and so those portions may be machined out, matching the shape of the adjacent layer 32, 62, to a fraction of the thickness of the plate. For example the plates 40, 42, 64 and 66 might be 20 mm thick, but those portions may be machined down to a thickness of 5 or 10 mm. This reduces the overall weight of the loudspeaker 10, 60.

The loudspeakers 10, 60 incorporate a driver 35 that may be of a known form, comprising a movable loudspeaker element such as a cardboard cone with an electrical actuator such as a coil, mounted within a frame. The frame would conventionally be formed of cage-like open framework, of generally conical shape, defining large apertures behind the movable loudspeaker element so that its motion is not impeded. In an alternative aspect of the invention a sound-suppressing duct may be incorporated within the frame of the driver. This may be instead of, or in addition to, the provision of a sound-suppressing duct within the housing as in the loudspeakers 10, 60.

Figure 8:
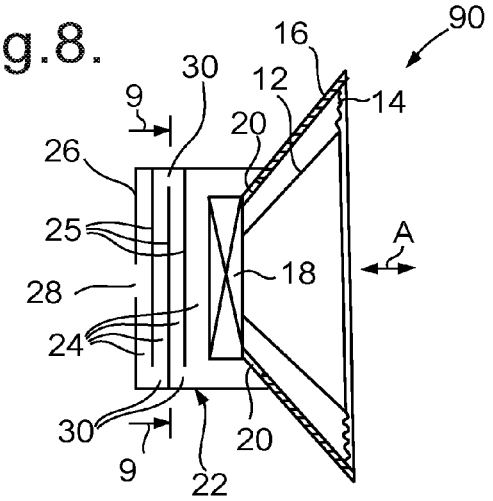
FIG. 8 is a sectional view of an acoustic driver of a first embodiment.

So, referring now to FIG. 8, an acoustic driver 90 includes a lightweight cone 12 with a flexible peripheral flange 14 at its wider end by which the cone 12 is attached to a frusto-conical frame 16. The narrower end of the cone 12 carries a coil (not shown) within a magnetic field of a ring magnet 18 carried at the narrower end of the frame 16, such that an alternating electric current in the coil causes the cone 12 to move to and fro as indicated by the arrow A. These features are conventional, apart from the design of the frame 16.

In a conventional acoustic driver, the frusto-conical frame would be a cage-like structure, defining multiple large apertures, so the cone 12 is free to move freely in both directions. In the acoustic driver 90 of FIG. 8, the frusto-conical frame 16 is a continuous frusto-conical surface, defining only four small apertures 20 equally spaced around the edge of the ring magnet 18, each aperture 20 being about a twentieth of the diameter of the acoustic driver 10 (only two of these apertures 20 being shown in FIG. 8).

These apertures 20 communicate with a cylindrical sound-suppressing chamber 22 attached to the rear of the frusto-conical frame 16, concentric with and surrounding the ring magnet 18. The cylindrical sound-suppressing chamber 22 is subdivided, in this example, into four successive cylindrical chambers 24 by three baffle plates 25, and has an end plate 26 with a central outlet aperture 28.

Figure 9:
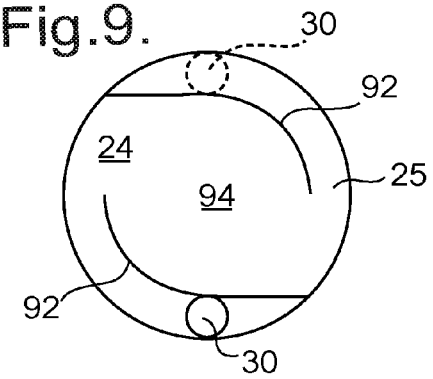
FIG. 9 is a view on the line 9-9 of FIG. 8.

Referring now to FIG. 9, each baffle plate 25 defines a circular aperture 30 (of diameter between about 10% and 20% that of the baffle plate 25) near one edge, and the apertures 30 in successive baffle plates 25 are on opposite sides, diametrically opposite each other (as indicated in broken lines in FIG. 9). Hence any air flow through the cylindrical sound-suppressing chamber 22 due to the movement of the cone 12 requires the air to repeatedly flow through small apertures 30 and then into the much larger cylindrical chambers 24. This has the effect of suppressing sound waves. In this example the outlet aperture 28 is larger than each of the apertures 30, and is at the centre of the end plate 26; in a modification the outlet aperture 28 might be diametrically opposite the aperture 30 leading into the final cylindrical chamber 24.

Each cylindrical chamber 24 is subdivided by two partly arcuate baffles 92 (not shown in FIG. 8) which project out from opposite sides of the cylindrical chamber 24, the arcuate portions being concentric with the wall of the cylindrical chamber 24, so that the arcuate portions together define a cylindrical space 94 concentric within the cylindrical chamber 24. The inlet aperture 30 and the outlet aperture 30 (indicated in broken lines) are separated from the cylindrical space 94 by the respective partly arcuate baffles 92.

Hence in use, air flowing from the inlet aperture 30 to the outlet aperture 30 must flow through the curved paths defined between the arcuate portions of the baffles 92 and the concentric wall of the cylindrical chamber 24, and must also flow through the cylindrical space 94. Air flowing into the cylindrical space 94 from the inlet aperture 30 must be flowing clockwise (as shown) whereas air flowing out of the cylindrical space 94 towards the outlet aperture 30 must be flowing anticlockwise. The air flow within the cylindrical space 94 tends to form a vortex, and the higher the in-flow velocity the greater the tendency to form the vortex; however the vortex inhibits outflow. So the baffles 92 further suppress sound transmission.

Figure 10:
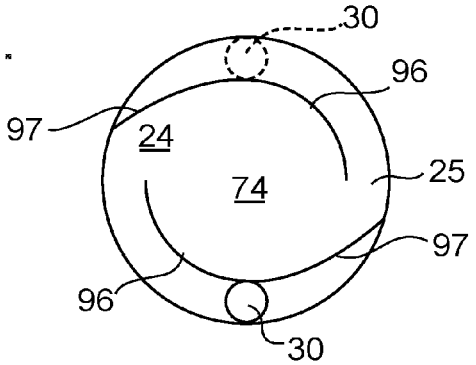
FIG. 10 is a view corresponding to that of FIG. 9, showing an alternative.

Referring now to FIG. 10, in a modification to the arrangement within the cylindrical chamber 24, there may be two arcuate baffles 96 that are curved throughout their length, having a portion concentric with the wall of the cylindrical chamber 24 as described above, and a curved portion 97 of larger radius to link to the wall.

Figure 11:
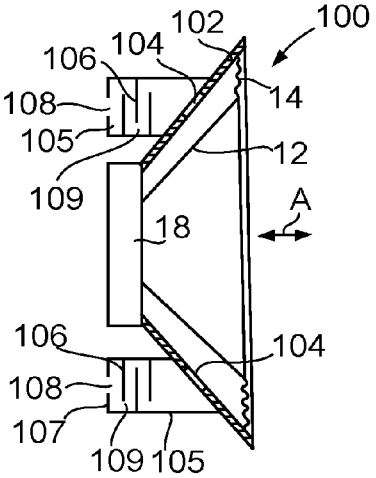
FIG. 11 is a sectional view of a first modification to the acoustic driver of FIG. 8.

Referring now to FIG. 11, this shows an acoustic driver 100 which is a modification to the acoustic driver 90, identical features being referred to by the same reference numerals. The acoustic driver 100 includes a lightweight rigid cone 12 with a flexible peripheral flange 14 at its wider end by which the cone 12 is attached to a frusto-conical frame 102. The narrower end of the cone 12 carries a coil (not shown) within a magnetic field of a ring magnet 18 carried at the narrower end of the frame 102, such that an alternating electric current in the coil causes the cone 12 to move to and fro as indicated by the arrow A. As mentioned above, these features are conventional, apart from the structure of the frame 102.

In the acoustic driver 100 of FIG. 11, the frusto-conical frame 102 is a continuous frusto-conical surface, defining only two small apertures 104 on opposite sides, each aperture 104 being about a twentieth of the diameter of the acoustic driver 100. These apertures 104 communicate with two cylindrical sound-suppressing chambers 105 attached to the rear of the frusto-conical frame 102. Each cylindrical sound-suppressing chamber 105 has an equivalent structure to that of the cylindrical sound-suppressing chamber 22 described above, as it is subdivided into a number of successive cylindrical chambers by successive baffle plates 106, and has an end plate 107 with a central outlet aperture 108. Each baffle plate 106 defines an aperture 109, and the apertures are staggered in successive baffle plates 106. Within each of the successive cylindrical chambers are baffles 92 or 96 as shown in FIG. 9 or FIG. 10. This cylindrical sound-suppressing chamber 105 consequently operates in substantially the same way as the cylindrical sound-suppressing chamber 22, suppressing sound transmission from the rear of the cone 12.

Figure 12:
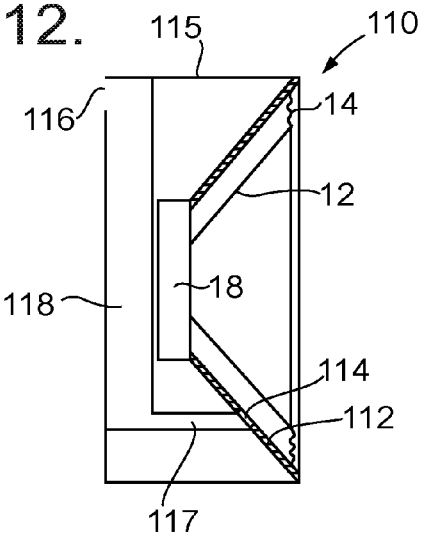
FIG. 12 is a sectional view of a second modification to the acoustic driver of FIG. 8.

Referring now to FIG. 12, this shows an acoustic driver 110 which is an alternative modification to the acoustic driver 90, identical features being referred to by the same reference numerals. The acoustic driver 110 includes a lightweight rigid cone 12 with a flexible peripheral flange 14 at its wider end by which the cone 12 is attached to a frusto-conical frame 112. The narrower end of the cone 12 carries a coil (not shown) within a magnetic field of a ring magnet 18 carried at the narrower end of the frame 112, such that an alternating electric current in the coil causes the cone 12 to move to and fro. As mentioned above, these features (apart from the structure of the frame 112) are conventional.

The frusto-conical frame 112 is a continuous frusto-conical surface, defining a single small aperture 114 on one side. The aperture 114 is between a tenth and a twentieth of the diameter of the acoustic driver 110. The acoustic driver 110 is mounted within a housing 115 which includes an outlet aperture 116 at the top of the rear face (as shown). A pipe 117 communicates between the aperture 114 and a sound-suppressing chamber 118 within the housing 115, and the sound-suppressing chamber 118 communicates with the outlet aperture 116. The detailed internal structure of the sound-suppressing chamber 118 is not shown, but it contains vortex chambers to suppress sound transmission, for example it may include multiple baffle plates as described in relation to the sound-suppressing chambers 22 and 105, in combination with arcuate baffles 92 or 96 to cause vortex flow as described above.

Thus in each case the effect of the cylindrical sound-suppressing chamber 22, or of the cylindrical sound-suppressing chambers 105, with the baffles 92 or 96, is to suppress sound waves from emerging through the outlet aperture 28, 108 or 116. Nevertheless there is no restriction on airflow between the rear of the cone 12 and the surroundings, so the movements of the cone 12 are not inhibited by pressure fluctuations.

The acoustic drivers 90, 100, 110 have been found to produce clearer and more accurate sound, as compared to an acoustic driver mounted in a completely sealed housing, or mounted in a housing with a conventional port. This is because with a sealed housing, air behind the cone 12 is compressed, which inhibits the movement of the cone 12;

while with a conventional port, sound emerges from the port and can interfere with sound from the front of the acoustic driver.

The acoustic drivers 90, 100, 110 may be mounted within a conventional loudspeaker housing, as long as the housing provides a port for communication with the surroundings; and indeed may be used without any such housing. The acoustic drivers 90, 100 could also be used in a housing such as that in the loudspeakers 10 and 60 described above, taking the place of the driver 35. In this case the sound from the rear of the cone 12 is suppressed firstly by the sound-suppressing chamber 22 (or 105); and then is further suppressed by the vortex chambers in the duct leading to the outside of the housing, such as those defined by the apertures 52, 53 and the openings 50 in the loudspeaker 10.

The acoustic drivers 90, 100, 110 may be constructed of conventional materials. For example the frame 16 may consist of a thin wall of cast aluminium, while the cylindrical sound-suppressing chamber 22 may be formed of metal sheets welded together. It will be appreciated that the walls and baffles 25 of the cylindrical sound-suppressing chamber 22 should be sufficiently rigid not to undergo significant vibration. Subject to that limitation, the wall thicknesses are not a critical parameter, as the external shape of the cylindrical sound-suppressing chamber 22 does not affect the sound transmission.

Figure 13:
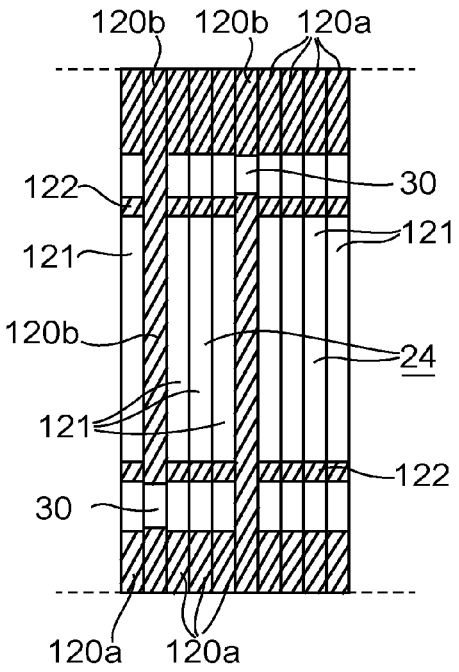
FIG. 13 shows a detailed sectional view of part of the acoustic driver of FIG. 8 in an embodiment which is formed of plates.

Referring now to FIG. 13, as an alternative, the cylindrical sound-suppressing chamber 22 (or the cylindrical sound-suppressing chamber 105) may be made of a stack of plates 120*a*, 120*b*, with plates 120*a* defining aligned circular apertures 121 to define the cylindrical chambers 24, and with plates 120*b* defining apertures 30 and so corresponding to the baffles 25. The plates 120 would be secured together into a laminated integral structure. For example the plates may be bonded together, or may be clamped together using bolts.

Figure 14:
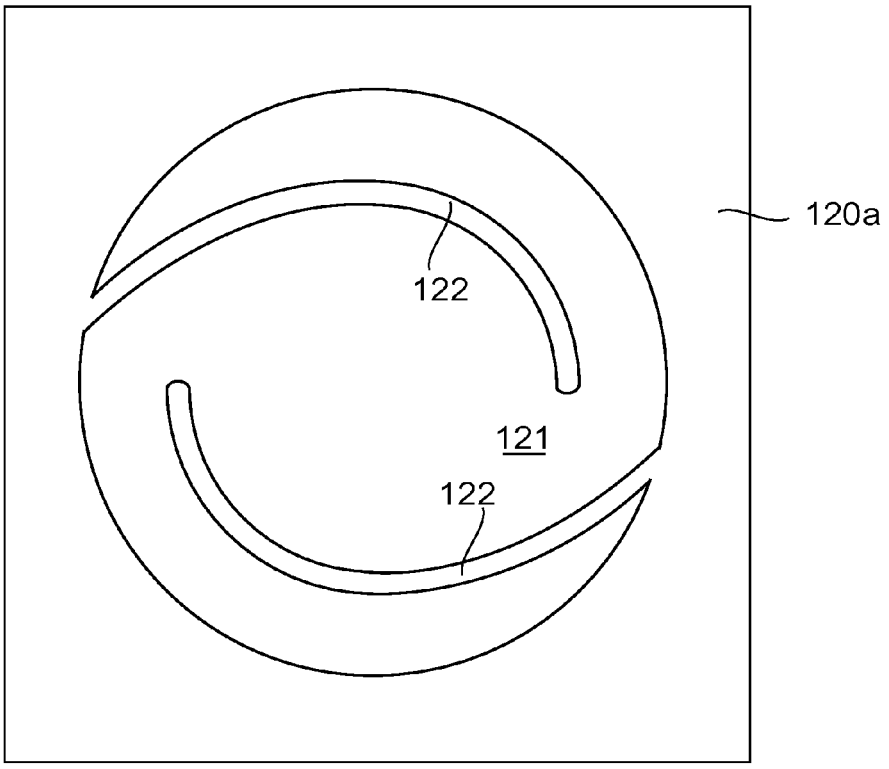
FIG. 14 shows a plan view of a plate which may be used in the structure of FIG. 13.

In this case the cylindrical chambers 24 have arcuate baffles equivalent to the baffles 96 of FIG. 5. Hence each plate 120*a* defining a circular aperture 121 to define part of the cylindrical chamber 24 is integral with projecting strips 122. Referring now to FIG. 14 there is shown a plan view of a plate 120*a* which defines a circular aperture 121; the plate 120*a* also defines projecting curved strips 122, so that when the plates 120*a* are stacked together the curved strips 122 define the arcuate baffles 96 as described above. In this example the plate 120*a* is square as regards its external shape, although it will be appreciated that the external shape might instead be a different shape, such as circular.

Each plate 120 is substantially flat, and can be described as a sheet or lamina. It may be of any convenient solid material, for example metal, wood, or a wood-based material such as medium-density fibreboard (MDF), plywood, or plastic or paper. In one example each plate 80 is of MDF. In another example each plate 120 is of a plastic, for example an engineering plastic such as acrylonitrile butadiene styrene (ABS), a polyamide (PA), or polyether ether ketone (PEEK).

The plates 120 may be stacked between a front plate and a rear plate that are stiffer than the plates 120, and may be of a more rigid material. For example they may be 20 mm thick sheets of aluminium. The plates 120 and the front plate and rear plate may be also provided with aligned holes for bolts. Hence the cylindrical sound-suppressing chamber 22 may be assembled by forming a stack of the plates 120 between the front plate and the rear plate, inserting the bolts, attaching a nut to each bolt, and tightening all the bolts so that the laminated walls of the cylindrical sound-suppressing chamber 22 are compressed.

During assembly, as the bolts are tightened, if you tap on the sidewall the tone of the resulting noise provides a clear indication as to when an adequate compressive force has been achieved as the tone will change from a dull knock to a much higher pitched note. The amount of compressive force required depends on the material of the plates 120, the depth of the structure (between the end plates) and the thickness of the side walls of the resulting cavity defined by the openings 121. The preferred compressive force is significantly greater than that which would be achieved only by conventional tightening of the bolts. However, it is not essential that such a high compressive force is applied in this context.

As described above, a duct including sound-suppressing vortex chambers may be included in a housing of laminated construction, as in the loudspeakers 10 and 60. Furthermore a duct including sound-suppressing vortex chambers may be coupled with a frame that supports the loudspeaker cone 12, as in the drivers 90, 100 and 110. There are many other ways in which a duct that includes sound-suppressing vortex chambers may be incorporated in a loudspeaker. For example, in the case of a conventional box-like loudspeaker housing provided with a port, a cylindrical sound-suppressing chamber 22 or 105 may be mounted in the port, so any airflow must pass through the silencing chamber 22 or 105. As described above, the cylindrical sound-suppressing chamber 22 or 105 defines a number of vortex chambers in series. Indeed if such a loudspeaker housing is provided with a plurality of ports, then each port would be provided with such a sound-suppressing chamber 22 or 105.

Figure 15A:
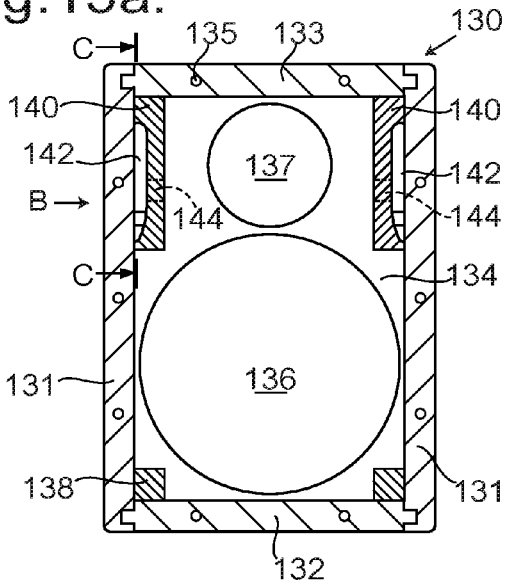
FIG. 15*a* shows a sectional view through an alternative loudspeaker.
Figure 15B:
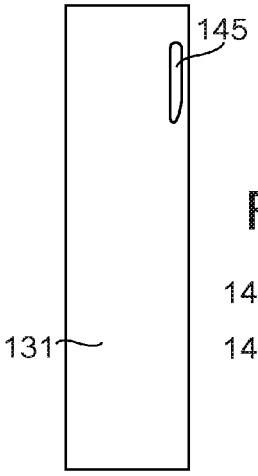
FIG. 15*b* shows a side view, in the direction of arrow B of FIG. 15*a;*
Figure 15C:
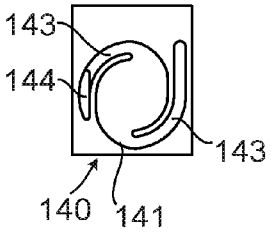
FIG. 15*c* this shows a plan view of a component of the loudspeaker of FIG. 15*a*, corresponding to the view on the line C-C.

Referring now to FIGS. 15*a* to 15*c*, in a further variation, a loudspeaker 130 may be provided with ports, each including a respective vortex chamber, in one or more of its walls. For example a box-like housing may include at least portions of the walls that consist of two plates bonded together, with vortex chambers defined between the plates. The loudspeaker 130 includes a rectangular housing formed of sheets of MDF material: two side walls 131, a base wall 132 and a top wall 133 which form a rectangular enclosure and are clamped between a front plate 134 and a back plate (not shown), with bolts (not shown) inserted through holes 135. The front plate 134 defines two circular apertures 136 and 137 to support acoustic drivers (not shown).

The bottom corners are reinforced by square-section bars 138. The top portion of each side wall 131 includes an inner plate 140 which is glued onto the sidewall 131 and extends to the top corner of the housing. There is a recess 141 formed in the surface of the inner plate 140 facing the sidewall 131, this recess 141 defining a generally circular cavity 142 and two arcuate channels 143 linked to the cavity 142 at diametrically opposite positions, both the channels 143 extending in a generally anticlockwise direction as shown in FIG. 15*c*. One channel 143 communicates through a slot-shaped port 144 through the thickness of the inner plate 140 with the inside of the housing. The other channel 143 communicates through a slot-shaped port 145 through the sidewall 131.

It will therefore be appreciated that there is an air flow path between the inside of the housing and the outside, through the slot-shaped port 144, the recess 141 and the slot-shaped port 145, on each side of the housing. Each flow path includes the arcuate channels 143 and the circular cavity 142, which are arranged so any air flow will tend to create a vortex that will inhibit through flow of air. Each therefore acts as a sound-suppressing duct. Thus the loudspeaker 130 incorporates two sound-suppressing ducts operating in parallel.

Figure 16A:
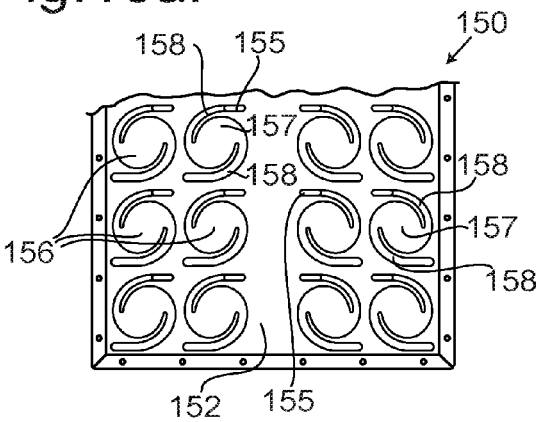
FIG. 16*a* shows a plan view of an inner sheet forming a laminated wall of a loudspeaker housing.
Figure 16B:
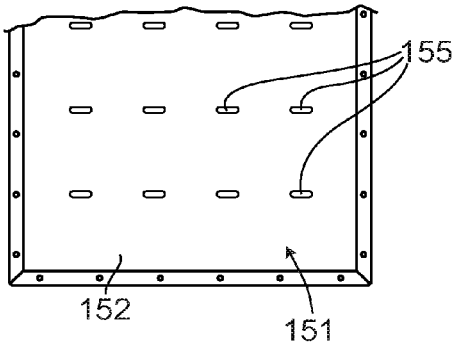
FIG. 16*b* shows a plan view of the inner surface of the inner sheet of FIG. 16*a;*
Figure 16C:
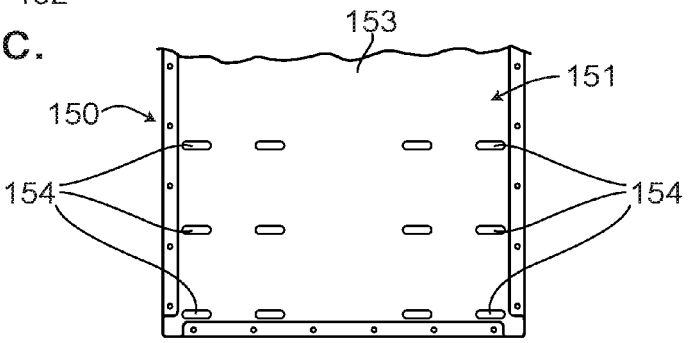
FIG. 16*c* shows a plan view of the outer surface of an outer sheet of the laminated wall of FIG. 16*a;*

Referring now to FIGS. 16*a* to 16*c*, in an alternative, a loudspeaker housing 150 may have multiple such sound-suppressing vortices. The loudspeaker housing 150 includes a wall 151 of laminated construction, consisting of two sheets, an inner sheet 152 and an outer sheet 153, bonded together. Both sheets may for example be of MDF or plywood, or of plastic. The outer sheet 153, as shown in FIG. 16*c*, defines an array of slot-shaped ports 154. The inner sheet 152, as shown in FIG. 16*b*, defines an array of slot-shaped ports 155 which do not align with the ports 154. As shown in FIG. 16*a* there are multiple recesses 156 formed in the surface of the inner sheet 152 facing the outer sheet 153. Each recess 156 has a shape similar to that of the recesses 141 described above, as it defines a generally circular cavity 157 and two arcuate channels 158 linked to the cavity 157 at diametrically opposite positions. As regards each recess 156, the end of one channel 158 communicates with a port 155, while the end of the other channel 158 communicates with a port 154 in the outer sheet 153.

Thus in operation there are multiple air flow paths between the inside of the housing and the outside, through the slot-shaped ports 145, the recesses 156 and the slot-shaped ports 154 which are arrayed across the wall 151. All these air flow paths are in parallel. Each such flow path includes the arcuate channels 158 and the circular cavity 157, which are such that any airflow will tend to create a vortex that will inhibit through flow of air. Each such flow path therefore acts as a sound-suppressing duct.

It will also be appreciated that such an array of sound-suppressing ducts in parallel may be provided in more than one wall of the housing 150. For example such sound-suppressing ducts may be provided in the back wall and both side walls of a housing 150. It will also be appreciated that although the sound-suppressing ducts in the wall 151 are described as being in a regular array, they may instead be arranged in any convenient manner.

It will also be appreciated that the recesses 141 or 156 may, as described, be formed in the outer surface of the inner sheet 140 or 152, but might alternatively be formed in the inner surface of the outer sheet 131 or 153. Alternatively matching recesses might be formed on the opposed faces of both the inner sheet 140 or 152 and of the outer sheet 131 or 153.

It will be appreciated that a loudspeaker utilising the housing 150 may contain a conventional driver, or alternatively may contain a driver 90 or a driver 100 which includes a sound-suppressing chamber 22 or 105, so any sound coming from the rear of the cone 12 must pass not only through the sound-suppressing chamber 22 or 105, but also through the sound-suppressing ducts provided by the recesses 156. Similarly a driver 90 or 100 might be mounted within the housing 130, or may be used in place of the driver 35 in the loudspeakers 10 or 60.

In the loudspeaker 130 and the loudspeaker housing 150 the sound suppressing ducts extend through a wall 131 or 151 to the outside of the structure. In the loudspeaker 10, the sound suppressing ducts communicate with an opening 50 that communicates with a port 45 in a wall of the structure. It will be appreciated that sound suppressing ducts can be provided in a conventional loudspeaker housing having an outlet port (for example in a rear wall or a side wall) by arranging sound suppressing ducts that communicate with that outlet port. This would for example be applicable in a box-like loudspeaker housing like the loudspeaker housing 130 but without the sound suppressing ducts through the walls, and instead having at least one outlet port for example in a rear wall or a sidewall.

Figure 17A:
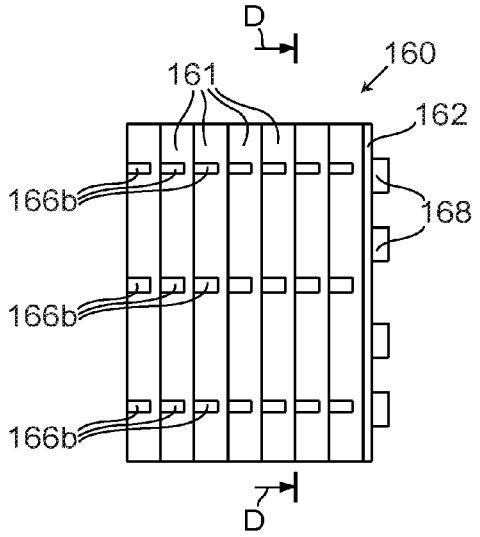
FIG. 17*a* shows a side view of a sound-suppressing module.
Figure 17C:
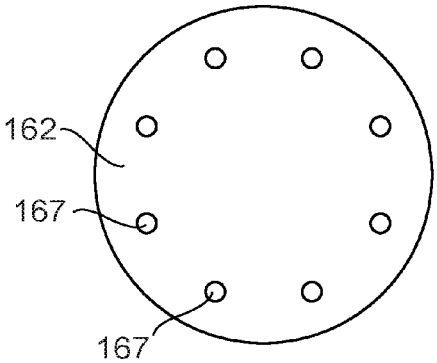
FIG. 17*c* shows a plan view of a circular end plate of the module of FIG. 17*a*.
Figure 17B:
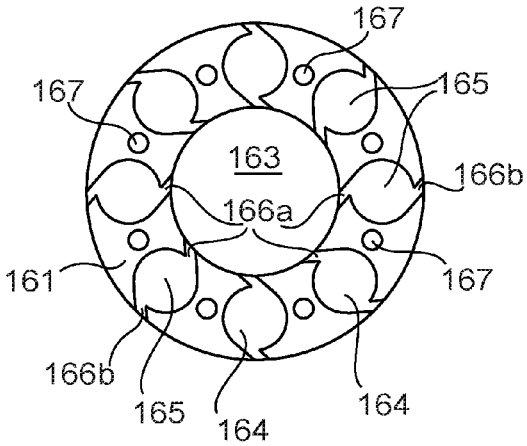
FIG. 17*b* shows a plan view of an annular plate in the module of FIG. 17*a*, corresponding to a view on the line D-D.

For example, referring to FIGS. 17*a* to 17*c*, there is shown a sound suppressing module 160. The sound-suppressing module 160 is of cylindrical shape, and is made of a stack of annular plates 161 and a circular rear plate 162 (see FIG. 17*c*); in this example each plate 161 and 162 is of external diameter 100 mm, each annular plate 161 defines a central circular aperture 163 of diameter 50 mm (see FIG. 17*b*). The circular rear plate 162 may be of steel, for example of thickness between 1 mm and 4 mm, whereas the annular plates 161 may be of a less rigid material such as an engineering plastic. In one example they are of thickness 10 mm, and of polyoxymethylene (e.g. Delrin™), which is a thermoplastic. Each annular plate 161 defines eight sound-suppressing ducts 164, each duct 164 being defined by a circular recess 165 linked to the inner and outer edges of the plate 161 by notches 166*a* and 166*b* which are tangential to the circular recess 164. The sound-suppressing ducts 164, that is to say the circular recesses 165 and the notches 166*a* and 166*b*, are of uniform depth, extending only part way through the thickness of the annular plate 161. Each annular plate 161 also defines eight holes 167 (see FIG. 17*b*) for clamping bolts 168 (see FIG. 17*a*), and these holes 168 extend right through the annular plate 161 and through the rear plate 162.

The sound suppressing module 160 is fixed to the wall of the loudspeaker housing (not shown) with the bolts 168 clamping the rear plate 162 and the annular plate 161 on to the wall, and with the central circular apertures 163 aligned with a port through the wall. The sound suppressing module 160 would normally be fixed to the inside of the wall, so it is within the housing and so not visible. The module 160 thus defines fifty-six sound-suppressing ducts 164, all arranged for air flow in parallel. The orientation of the notches 166*a* and 166*b* ensures that a vortex is formed within each circular recess 165 if any air flow occurs, and so the sound suppressing module 160 suppresses sound propagation.

It will be appreciated that the number of sound-suppressing ducts 164 can be altered by changing the number of annular plates 161 that are stacked together. It will also be appreciated that each annular plate 161 might define a different number of sound-suppressing ducts 164. Furthermore the plates 161 and 162 might be of a different diameter, or indeed of a different external or internal shape. In a further modification the sound-suppressing ducts 164 might be defined by matching recesses on annular plates that are clamped together (the recesses on adjacent plates being mirror images when seen in plan).

Figure 18:
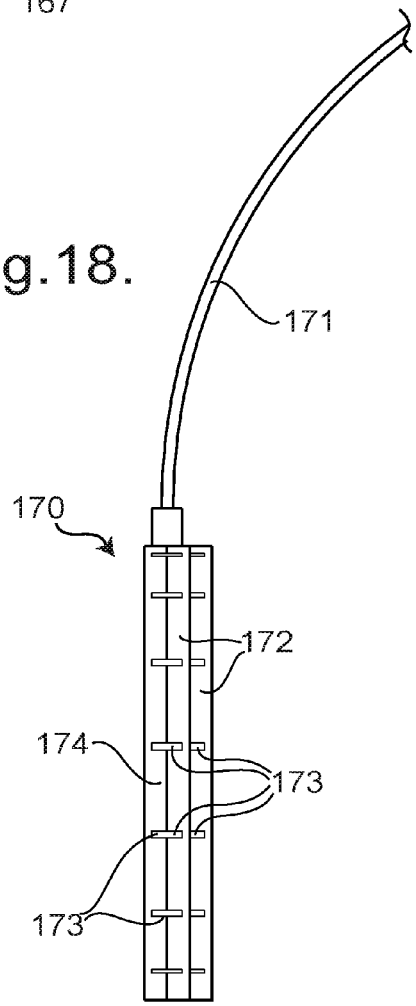
FIG. 18 shows a side view of a headphone.

The sound suppressing module 160 may be fixed to a wall of a loudspeaker housing, as described above, but alternatively such a sound suppressing module may itself define the housing for a sound-generating device. This would for example be appropriate where the housing may itself be cylindrical. For example, referring now to FIG. 18, this shows a headphone 170 connected via a curved support 171 to a second headphone (not shown), to form a pair of headphones. The headphone 170 includes a thin driver (not shown) clamped between two annular plates 172 each of which defines sound-suppressing ducts of substantially the same shape as the sound-suppressing ducts 164 described above, and communicating through notches 173 with the outside of the headphone 170. The headphone 170 also includes a circular outer plate 174 which defines a circular central recess to match the diameter of the central hole of the annular plates 172, and which defines mirror image recesses and notches 173 to match the recesses and notches 173 of the adjacent annular plate 172. By way of example the annular plate 172 and the outer plate 174 may be of aluminium, and they may be held together by bolts (not shown).

Thus in use pressure fluctuations in the regions behind and in front of the thin driver of the headphone 170 are suppressed, as air can flow through the multiple sound-suppressing ducts, but the circular chambers and the notches 173 ensure that any air flow will create a vortex, suppressing sound propagation.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

The invention claimed is:

1. A sound-suppressing duct suitable for use in a loudspeaker housing or incorporated within an acoustic device for use with a movable loudspeaker element, the sound-suppressing duct incorporating at least one vortex chamber, the vortex chamber being part of the duct and being arranged such that any airflow in the duct will create a vortex in the vortex chamber, the vortex chamber absorbing sound waves propagating through the duct and so suppressing sound waves.

2. A sound-suppressing duct as claimed in claim 1 incorporating at least two vortex chambers in series.

3. A sound-suppressing duct as claimed in claim 2 wherein the vortex chambers that are in series are arranged such that successive vortices are in opposite directions.

4. A sound-suppressing module which defines a multiplicity of sound-suppressing ducts as claimed in claim 1 arranged in parallel.

5. The acoustic device for use with the movable loudspeaker element, the acoustic device defining an enclosure with an aperture to locate the movable loudspeaker element, and with a port communicating with the outside of the enclosure, wherein the acoustic device includes at least one sound-suppressing duct as claimed in claim 1 to suppress sound waves from the port.

6. An acoustic device as claimed in claim 5 wherein each sound-suppressing duct incorporates at least two vortex chambers in series.

7. An acoustic device as claimed in claim 6 wherein the vortex chambers that are in series are arranged such that successive vortices are in opposite directions.

8. An acoustic device as claimed in claim 5 comprising a plurality of sound-suppressing ducts arranged in parallel for any air flow.

9. An acoustic device as claimed in claim 5 which is of laminated construction.

10. An acoustic device as claimed in claim 9 comprising a plurality of layers held together under compressive force.

11. An acoustic device as claimed in claim 5 which is a housing for the movable loudspeaker element.

12. A loudspeaker comprising the housing as claimed in claim 11 in combination with the movable loudspeaker element.

13. An acoustic device as claimed in claim 5 which is a frame for the acoustic driver.

14. A driver comprising the acoustic device as claimed in claim 13 in combination with the movable loudspeaker element.

15. A loudspeaker comprising a housing enclosing a driver, wherein the housing incorporates a first sound-suppressing duct; and wherein the driver comprises a frame and a movable loudspeaker element, the frame defining an enclosure with an aperture to locate the movable loudspeaker element, and with a port communicating with the outside of the enclosure, with a second sound-suppressing duct to suppress sound waves from the port; wherein the first sound-suppressing duct and the second sound-suppressing duct are each sound suppressing ducts as claimed in claim 1.

* * * * *